US009447331B2

(12) United States Patent
Brodt

(10) Patent No.: US 9,447,331 B2
(45) Date of Patent: Sep. 20, 2016

(54) PROCESSING COMBUSTIBLE MATERIAL METHODS AND SYSTEMS

(71) Applicant: S.G.B.D. TECHNOLOGIES LTD., Haifa (IL)

(72) Inventor: Alexander Brodt, Beer Sheva (IL)

(73) Assignee: S.G.B.D. TECHNOLOGIES LTD., Haifa (IL)

( * ) Notice: Subject to any disclaimer, the term of this patent is extended or adjusted under 35 U.S.C. 154(b) by 320 days.

(21) Appl. No.: 13/956,418

(22) Filed: Aug. 1, 2013

(65) Prior Publication Data

US 2015/0027931 A1 Jan. 29, 2015

(30) Foreign Application Priority Data

Jul. 29, 2013 (IL) ..... 227708

(51) Int. Cl.

| | |
|---|---|
| ***C10G 1/06*** | (2006.01) |
| ***B03B 9/00*** | (2006.01) |
| ***B03B 9/02*** | (2006.01) |
| ***B03B 7/00*** | (2006.01) |

(52) U.S. Cl.

CPC ..... *C10G 1/065* (2013.01); *B03B 7/00* (2013.01); *B03B 9/005* (2013.01); *B03B 9/02* (2013.01); *C10G 1/06* (2013.01)

(58) Field of Classification Search

CPC ..... C10G 1/06; C10G 1/065; B03B 5/28; B03B 7/00; B03B 9/005; B03B 9/02

See application file for complete search history.

(56) References Cited

U.S. PATENT DOCUMENTS 4,173,530 A * 11/1979 Smith ..... B01D 11/0207 209/11
4,893,986 A * 1/1990 Catterfeld ..... F04D 1/10 415/100
4,946,583 A * 8/1990 Wurfel ..... C10G 1/002 208/108

FOREIGN PATENT DOCUMENTS

SU 997441 10/1983

OTHER PUBLICATIONS

I.M. Goykrakh et al., "Liquid Fuel Chemistry and Production Process",Gostoptekhizdat, 1950, pp. 306-347.

* cited by examiner

*Primary Examiner* — Renee E Robinson
(74) *Attorney, Agent, or Firm* — Pearl Cohen Zedek Latzer Baratz LLP

(57) ABSTRACT

Methods, systems and units for liquefaction of combustible material are provided. After separating the combustible material from waste rock gravitationally in an aqueous salt solution selected to have a density which is intermediate between a density of the combustible material and a density of the waste rock and after heating and grinding the separated combustible material to yield a paste of purified combustible material, the paste is fluidizing and hydrogenated underground in a hydrogenation chamber including a Segner turbine. The described processes significantly reduce the energy consumption of the process, remove environmental hazards and result in more efficient liquefaction with respect to existing technologies.

20 Claims, 7 Drawing Sheets

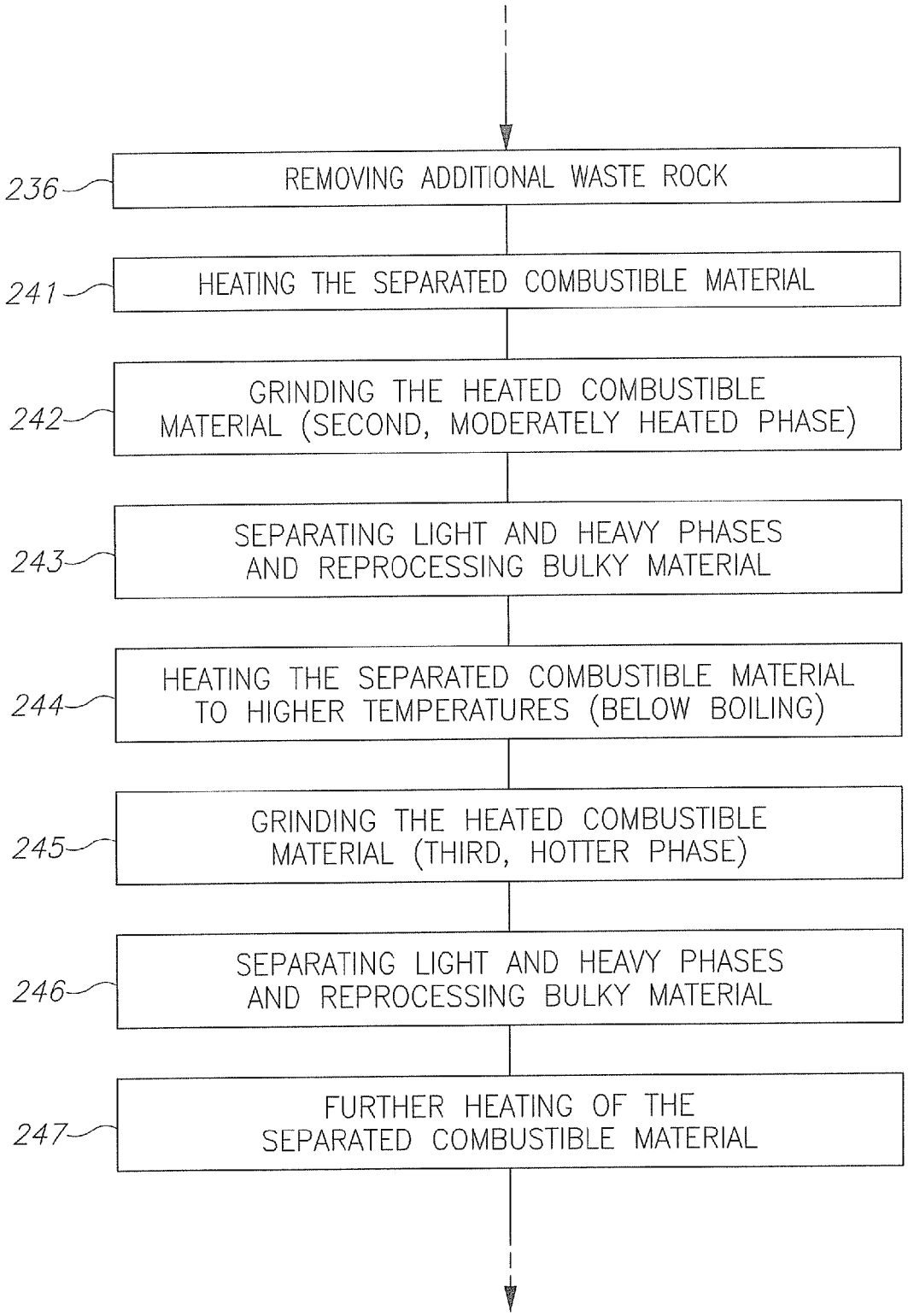
Figure 2B (cont. 1)

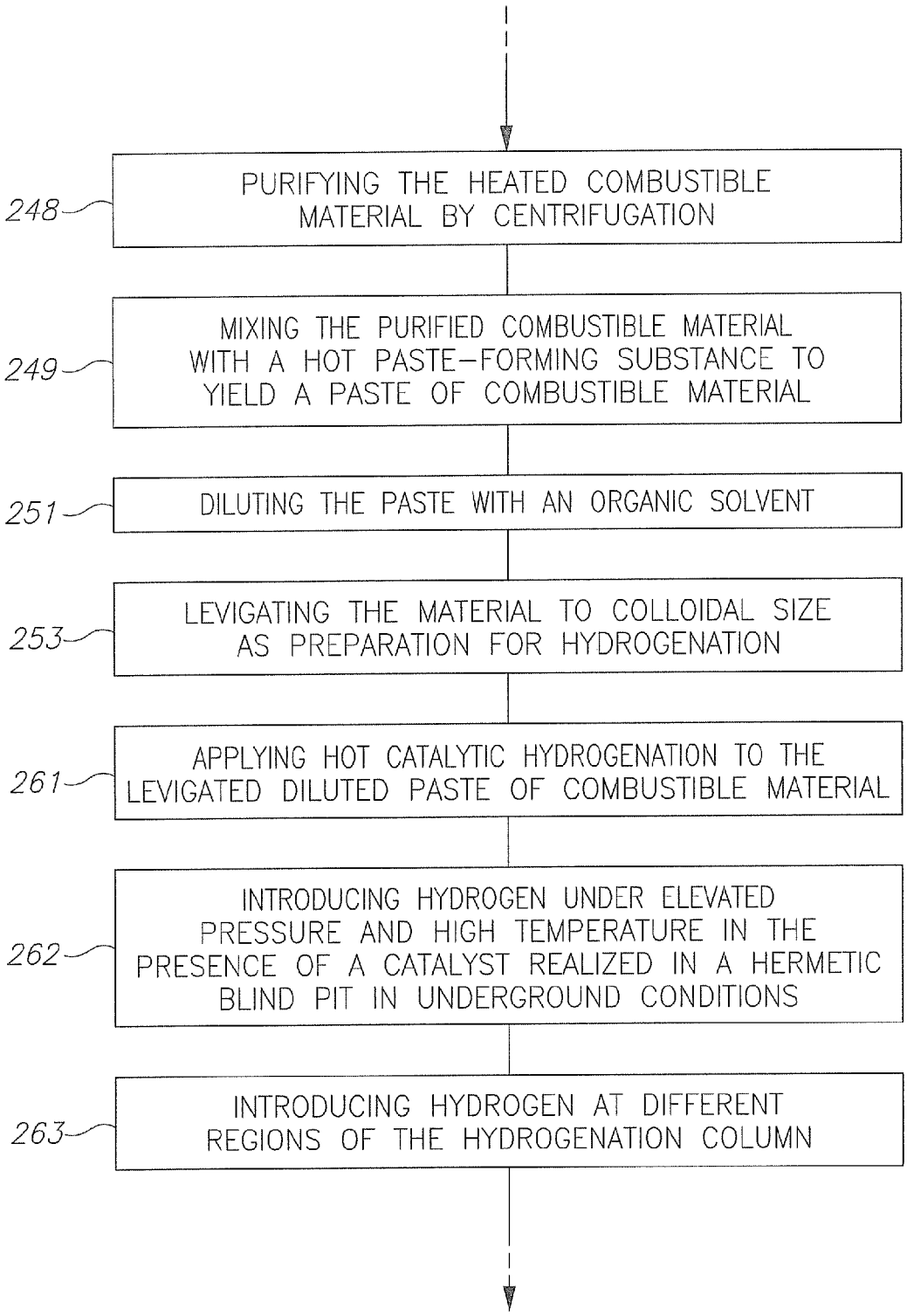
Figure 2B (cont. 2)

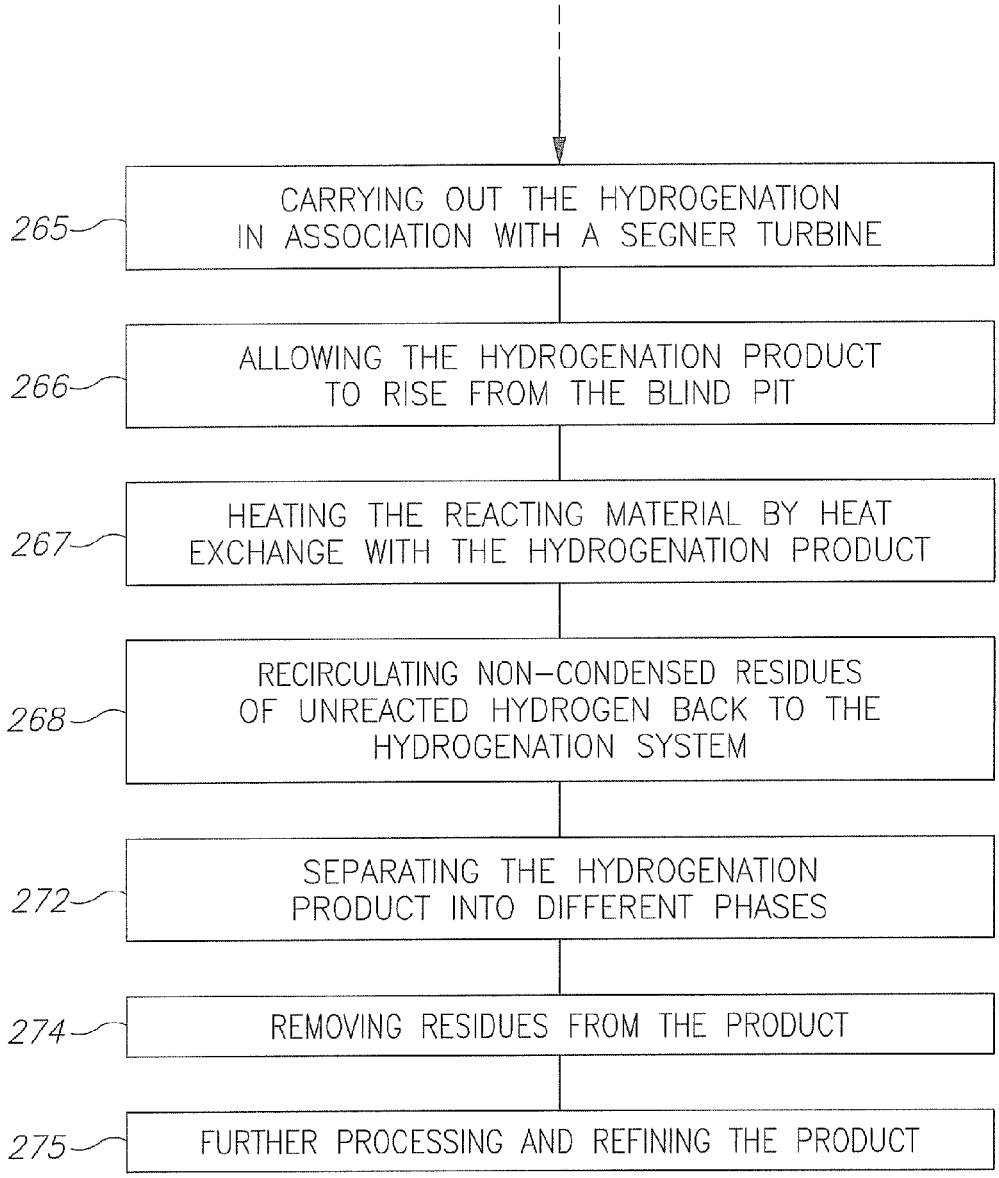
Figure 2B (cont. 3)

PROCESSING COMBUSTIBLE MATERIAL METHODS AND SYSTEMS

CROSS REFERENCE TO RELATED APPLICATIONS

This application claims the benefit of Israeli Patent Application No. 227708, filed on Jul. 29, 2013, which is incorporated herein by reference in its entirety.

BACKGROUND OF THE INVENTION

1. Technical Field

The present invention relates to the field of energy production, and more particularly, to liquefaction of combustible material such as fossil fuels.

2. Discussion of Related Art

Coal liquefaction is used to process coal and in particular to produce liquid fuel from coal (see e.g., the hundred years' old Bergius process). However, major difficulties in such processes involve the need to produce, process and transport huge amounts of fossil fuel for liquefaction, as well as the high energy demand of the process, environmental hazards posed by the liquefaction and by chemicals that are used in the process, as well as low processing efficiency in some cases.

SUMMARY OF THE INVENTION

One aspect of the present invention provides a method of separating and hydrogenating combustible material, the method comprising: separating the combustible material from waste rock gravitationally in an aqueous salt solution selected to have a density which is intermediate between a density of the combustible material and a density of the waste rock; heating and grinding the separated combustible material to yield a paste of purified combustible material; fluidizing the paste; and hydrogenating the fluidized paste in association with a Segner turbine.

One aspect of the present invention provides a hydrogenation unit comprising: a vertical shaft arranged to receive a fluid combustible material and maintain a downwards flow thereof; a Segner turbine in fluid communication with the vertical shaft and arranged to be rotated by the flowing fluid combustible material; a hydrogenation chamber enclosing a bottom portion of the vertical shaft and the Segner turbine, the hydrogenation chamber comprising a heating unit arranged to heat the fluid combustible material and a hydrogen supply arranged to introduce hydrogen into the fluid combustible material that exits the Segner turbine, to yield a hydrogenated combustible fluid; and a vertical enclosure in fluid communication with the hydrogenation chamber and arranged to maintain an upwards flow of the hydrogenated combustible fluid from the hydrogenation chamber while enabling recuperative heat exchange between the rising hydrogenated combustible fluid and the downwards flow of fluid combustible material.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1A:
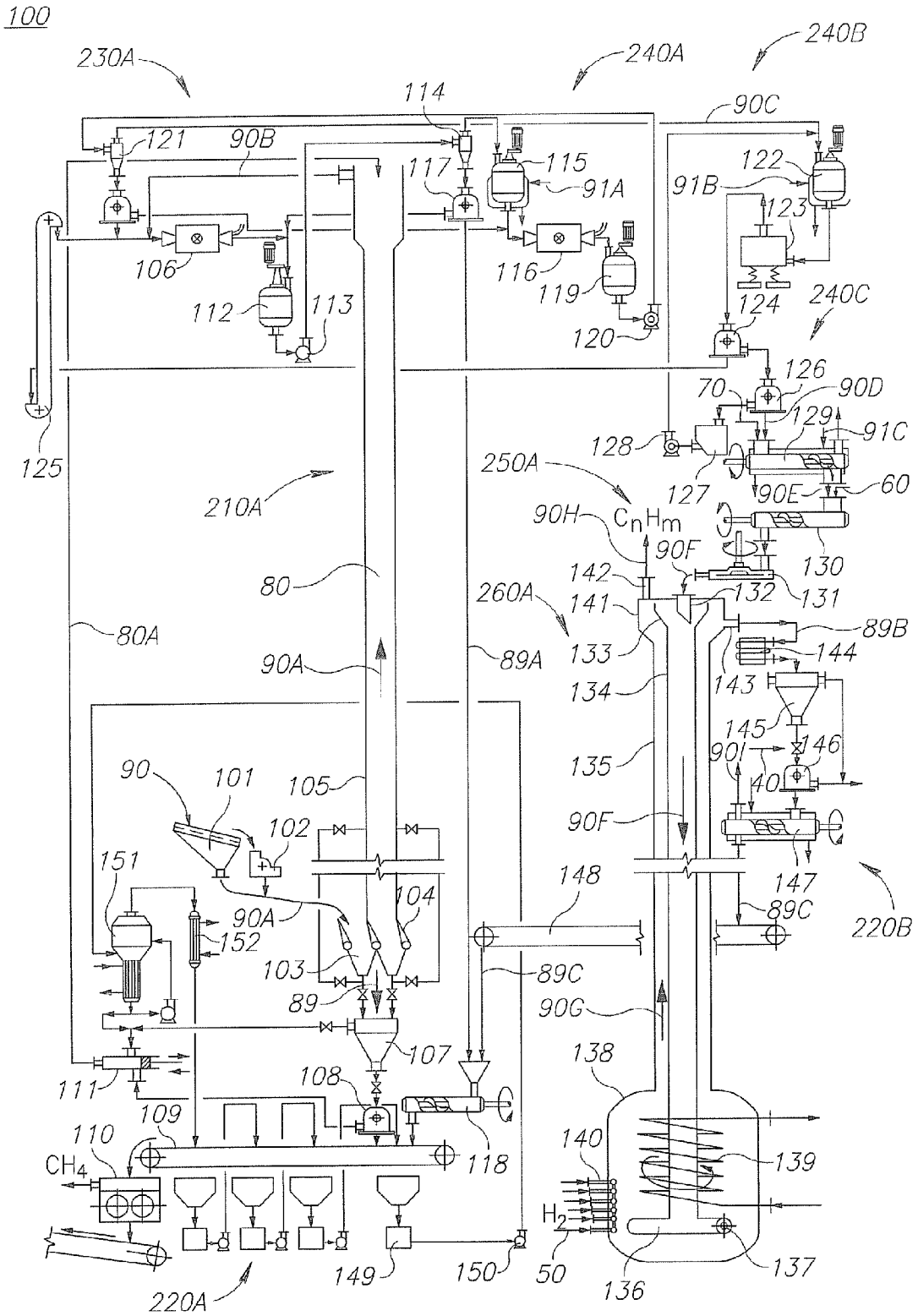
FIG. 1A is a schematic illustration of a non-limiting example for a combustible material processing system, according to some embodiments of the invention.

Prior to the detailed description being set forth, it may be helpful to set forth definitions of certain terms that will be used hereinafter.

The term "combustible material" as used in this application refers to the any kind of material used to generate energy, especially sedimentary rocks such as coal, oil shale and other types of fossil fuels.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Embodiments of the present invention enable a complex usage of the initial energy mineral, deepen its processing, reduce power intensity of the production of artificial liquid fuel, reduce investments for the erection of coal liquefaction facility and weaken harmful effect of the technological process on the environment by its realization in underground conditions. In certain embodiments, before the hydrogenation, the processing of the initial crushed mineral (in particular, coal) is started with preliminary separation of the combustible mineral from waste rock combined with its vertical transportation—floating of the mineral from the mining site to the site of its further processing in a vertical column filled with water-salt solution with the density exceeding that of coal. Principal ingredients for the preparation of the water-salt medium are ionogenic inorganic compounds that not only possess a high enough water solubility (which allows the produced water solutions to reach the density sufficient for coal floating), but also are highly active catalysts of the subsequent hydrogenation process.

Figure 1B:
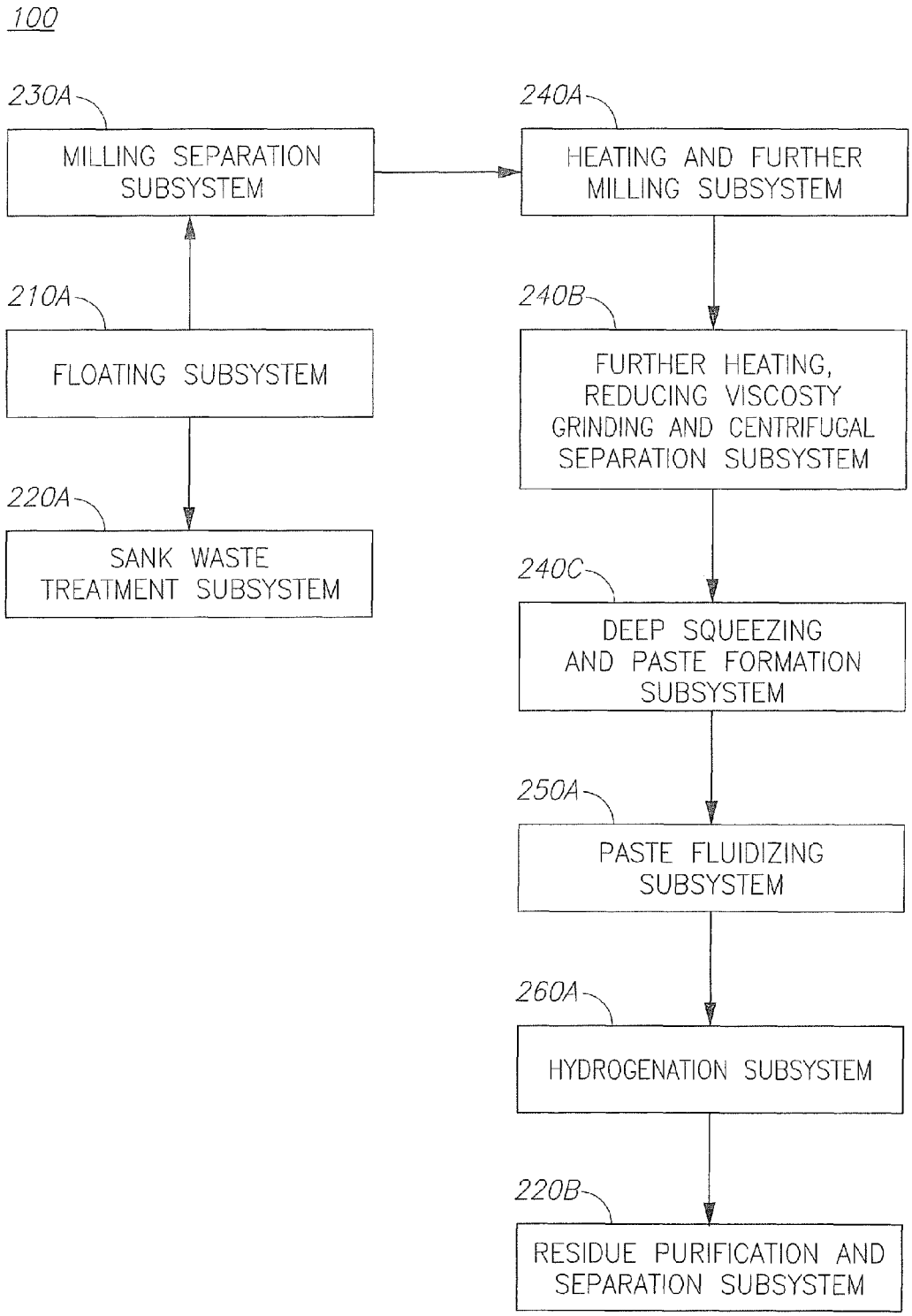
FIG. 1B is a high level schematic illustration of subsystem s in the combustible material processing system, according to some embodiments of the invention.
Figure 2A:
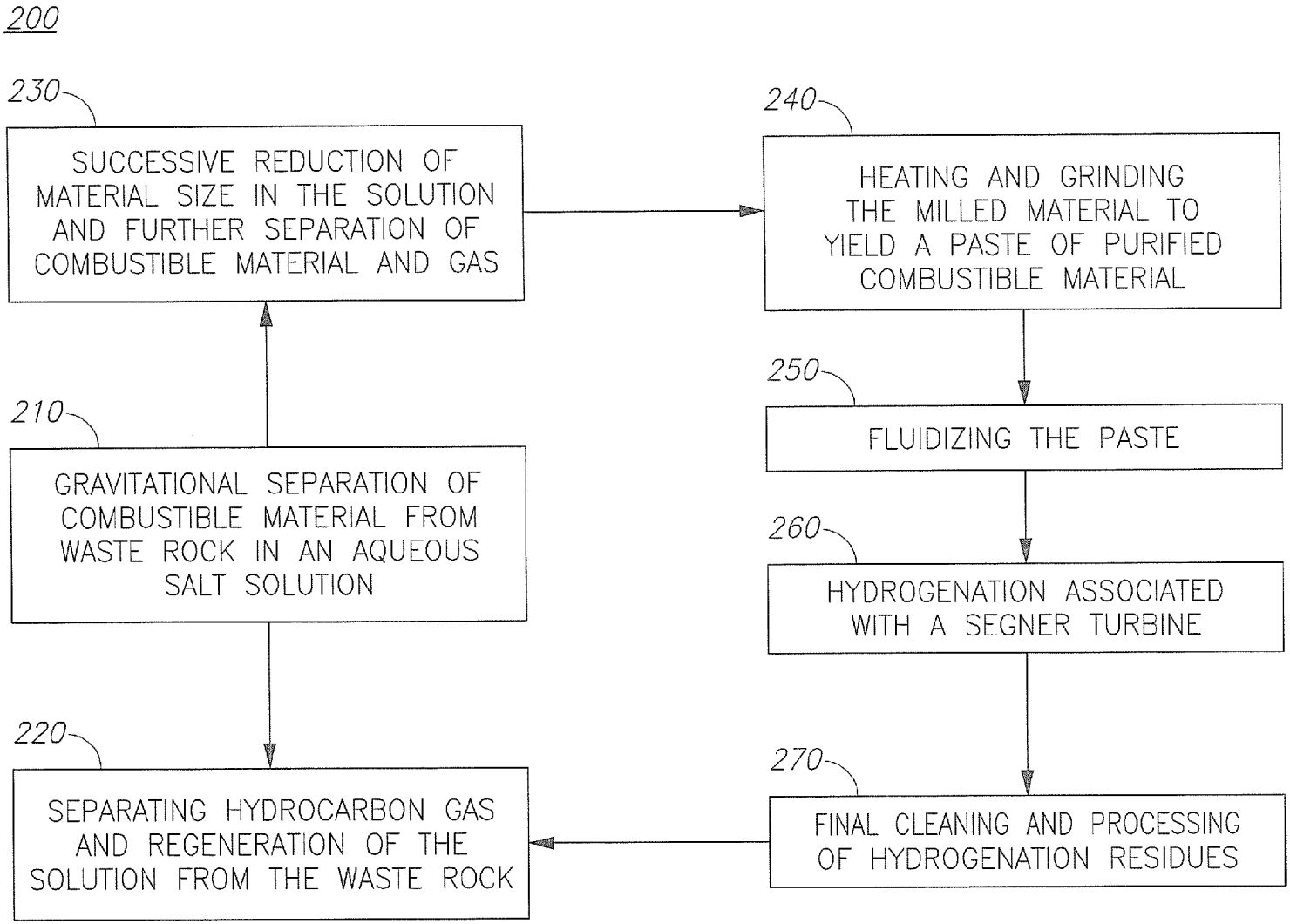
FIG. 2A is a high level schematic flowchart illustrating central stages of a method of separating and hydrogenating combustible material, according to some embodiments of the invention.
Figure 2B:
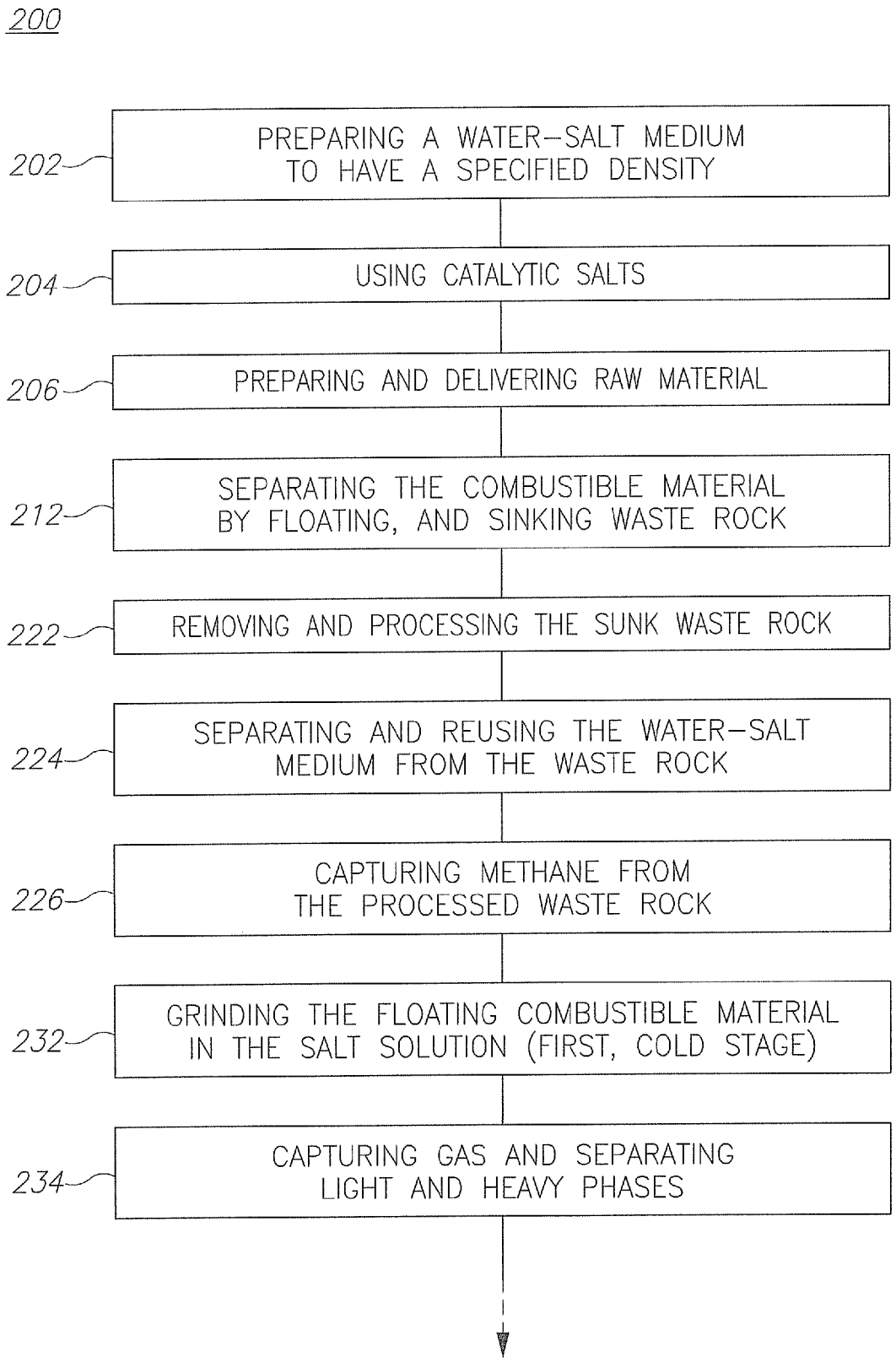
FIG. 2B is a high level schematic flowchart illustrating further stages of the method of separating and hydrogenating combustible material, according to some embodiments of the invention.

FIG. 1A is a schematic illustration of a non-limiting example for a combustible material processing system 100, according to some embodiments of the invention; FIG. 1B is a high level schematic illustration of subsystems in combustible material processing system 100, according to some embodiments of the invention; FIG. 2A is a high level schematic flowchart illustrating central stages of a method 200 of separating and hydrogenating combustible material, according to some embodiments of the invention; and FIG. 2B is a high level schematic flowchart illustrating further stages of method 200 of separating and hydrogenating combustible material, according to some embodiments of the invention.

Method 200 may comprise preparing a water-salt medium 80 to have a specified density (stage 202) and using catalytic salts (stage 204). The preparation of water-salt medium 80, which is intended for floating, grinding and step-by-step beneficiation of the original mineral by dissolving in water one or several mineral salts catalyzing the hydrogenation process. The preparation brings solution 80 to the density intermediate between those of combustible mineral 90 and contaminating mineral admixtures, i.e., waste rock 89.

Method 200 may further comprise preparing and delivering raw material 90 (stage 206), e.g., by preliminary dry preparation of freshly produced original raw material by size for charging it into a column of heavy water-salt medium for separating, in the course of the beneficiation-and-transportation process, a product refined with respect to its combustible component. Raw combustible material 90 is thus turned into prepared combustible material 90A.

Method 200 may further comprise separating the combustible material from waste rock 89 gravitationally in aqueous salt solution 80 selected to have a density which is intermediate between a density of combustible material 90A and a density of the waste rock (stage 210). This stage may be carried out in a floating subsystem 210A which comprises a vertical floating container 105 as described below. Method 200 may comprise separating the combustible material by floating and sinking waste rock (stage 212) by delivery of, e.g., coal, with its simultaneous release from the greatest part of waste rock, from the production site to the processing site by vertical floating in a water-salt medium with the density exceeding that of the coaly substance.

Waste rock 89 may be sunk in water-salt medium 80 and then be squeezed from the liquid phase, rinsed with water and ground, with simultaneous capturing of methane released into the gaseous phase in the course of the size reduction. After that the waste material may be arranged in the worked-out space. Method 200 may further comprise separating hydrocarbon gas and regeneration of the solution from the waste rock (stage 220). This stage may be carried out in sank waste treatment subsystem 220A and may comprise removal of sunk waste rock 89 from the water-salt medium, hydromechanically squeezing and cleaning the waste rock with water (together with all other solid wastes of coal-liquefaction industry) from the liquid phase residues and further grinding of the cleaned material, with simultaneous capturing of the released methane and operative arrangement of all solid waste of the technological process in the worked-out space. Hence, method 200 may further comprise removing and processing the sunk waste rock (stage 222); separating and reusing the water-salt medium from the waste rock (stage 224) and capturing methane from the processed waste rock (stage 226).

In certain embodiments, method 200 further comprises grinding (the first stage of refinement) of the floated (and beneficiated at the same time) initial mineral is carried out at the ambient temperature in the same solution (saturated with ingredients catalyzing the hydrogenation process), which has a density that exceeds that of the combustible mineral, but is lower than that of the waste rock. The successive reduction of the processed material size may be accompanied by a preliminary spatial separation of minerals composing the initial mineral. The light fraction enriched by its combustible component floats up out of the zone of grinding bodies, while the heavy material consisting mainly of waste minerals sinks in the water-salt medium flooding the drum mill. During grinding, methane may be released out of the ground material into the gaseous phase, be captured and sent to catalytic conversion with water vapor for obtaining hydrogen used in the process of hydrogenation (see below).

Method 200 may further comprise successively reducing particle size of the separated combustible material in the solution and removing residual waste rock and gas therefrom (stage 230), e.g., in a milling and separation subsystem 230A. The first (cold) stage of grinding the floating lumps of coal may be carried out with simultaneous concentration of the ground material realized at the ambient temperature in the same water-salt solution 80 saturated up to the density value that is exactly intermediate between those of the combustible and incombustible mineral components, with simultaneous capturing of methane released, in the course of grinding, into the gaseous phase, and subsequent separate outlet of light (crude concentrate) and heavy (final tailings) of beneficiation products out of the process. In certain embodiments, method 200 further comprises any of the stages: grinding (in a first, cold stage) the floating combustible material in the salt solution (stage 232); capturing gas and separating light and heavy phases (stage 234); and removing additional waste rock (stage 236).

In certain embodiments, before the second stage of grinding, a suspension of the light product (crude concentrate) of the first (cold) stage of grinding and beneficiation may be heated and additionally ground under moderate heating, together with its further separation. Then, the produced technological flow containing a solid phase, even more completely beneficiated with the coaly substance, is heated to a higher temperature, additionally ground to extra-fine state and, finally, precisely separated from the residues of visible mineral admixtures in a hot regime in a powerful centrifugal field. Method 200 may further comprise heating and grinding the combustible material of reduced particle size to yield a paste of purified combustible material (stage 240), e.g., in a heating and further milling subsystem 240A.

Method 200 may further comprise heating of the suspension of the light product of the first concentration stage to a moderate temperature; and carrying out a second (warm) stage of crude concentrate grinding and beneficiation in a heated aqueous solution with a simultaneous (as at the first stage of grinding) discharge of methane released during the decrease of the ground material size, and the subsequent separate output of the light product, which is fed after that to the last stage of material preparation by its size and composition before its liquefaction, and of the heavy product returned, respectively, to the first (cold) stage of the process for additional grinding. Method 200 may further comprise final heating of the beneficiated product of the warm stage of coal processing to a higher temperature, which is somewhat lower than the water-salt solution boiling point. In certain embodiments, method 200 further comprises any of the stages: heating the separated combustible material (stage 241); grinding (second, moderately heated phase) the heated combustible material (stage 242); separating light and heavy phases and reprocessing bulky material (stage 243) and heating the separated combustible material to higher temperatures (below boiling) (stage 244).

Method 200 may further comprise further heating, reducing viscosity, grinding and centrifugal separation in a heated grinding subsystem 240B. Method 200 may comprise a third (hot) stage of grinding with a subsequent final precise beneficiation of extra-fine coal in a strong centrifugal field in the same water-salt medium, but in hot separation mode, comprising grinding (third, hotter phase) the heated combustible material (stage 245) and separating light and heavy phases and reprocessing bulky material (stage 246).

Method 200 may further comprise mixing the obtained hot extra-pure coal concentrate with hot paste-former (at that, water from water-salt solution impregnating the coal concentrate starts boiling). Then the obtained paste may be diluted to a mobile consistence, the solid phase of the formed coal-oil mixture is levigated to a colloidal particles size and fed by a vertical rotating hollow shaft (ending with a T-shape reactive turbine—Segner wheel), which may be installed in the vertical well, to underground hydrogenation in a blind pit equipped with tangential introduction of hydrogen. This stage may be carried out in deep squeeze and paste formation subsystem 240C, in which hydromechanical squeezing of the final extra-pure coal concentrate from water-salt medium is carried out, with further mixing with hot paste-forming substance and simultaneous removal of excessive humidity from the squeezed cake by its boiling, and additional dilution of the obtained coal/oil mixture to the desired consistency with an organic solvent. In certain embodiments, method 200 further comprise further heating the separated combustible material (stage 247); purifying the heated combustible material by centrifugation (stage 248) and fluidizing the paste (stage 250), e.g., diluting the paste with an organic solvent (stage 251), in a paste fluidizing subsystem 250A. Method 200 may further comprise additional levigation of the solid phase of the coal/oil mixture prepared for hydrogenation to the colloidal size, e.g., levigation to colloidal size as preparation for hydrogenation (stage 253).

Method 200 may further comprise hydrogenating the diluted paste (stage 260), e.g., in a hydrogenation subsystem 260A. In certain embodiments, method 200 comprises recuperative heating of coal/oil mixture (by hot artificial petroleum rising in the opposite direction) and its subsequent feed into the hydrogenation process by a rotating vertical hollow shaft installed in a vertical well cut into a hermetic blind pit, while hydrogen is tangentially fed, at the same time, at several heights into the lower part of the blind pit; and hot catalytic hydrogenation of the coaly substance of solid phase of the coal/oil mixture by its interaction with hydrogen under elevated pressure at high temperature in the presence of a catalyst realized in a hermetic blind pit in underground conditions. In certain embodiments, method 200 further comprises any of the stages: applying hot catalytic hydrogenation to the levigated diluted paste of combustible material (stage 261); introducing hydrogen under elevated pressure and high temperature in the presence of a catalyst realized in a hermetic blind pit in underground conditions (stage 262); introducing hydrogen at different regions of the hydrogenation column (stage 263) and carrying out the hydrogenation e.g., in association with a Segner turbine (stage 265).

Method 200 may further comprise final cleaning and processing of hydrogenation residues (stage 270), e.g., in a residue purification and separation subsystem 220B, extraction of residual hydrocarbons and working liquids and processing waste material. Method 200 may comprise introducing liquid hydrogenate to rise from the blind pit to be released from gases dissolved in it by feeding the artificial petroleum discharged to the ground surface (through the annular gap between the rotating hollow shaft and vertical well connected with the blind pit) into a hollow volume, with simultaneous recuperative heat exchange between technological counter-flows between these heights. Hydrogenate rising from the blind pit through an annular gap between the rotating shaft and vertical well head may be released from dissolved hydrocarbon gases and separated into artificial petroleum and non-liquefied solid residue. The latter may be washed with organic solvent, dried and mixed with dewatered heavy product of the first grinding stage. The mixture of inert minerals free from organic admixtures may be rinsed with water and removed from the production cycle. Rinsing water remaining after washing this finely disperse waste, as well as that remaining after washing lump waste rock (which sank at the coal floating in water-salt medium), are evaporated to their initial density. The regenerated water-salt solution may be returned to the head of the process. In certain embodiments, method 200 further comprises any of the stages: allowing the hydrogenation product to rise from the blind pit (stage 266); heating the reacting material by heat exchange with the hydrogenation product (stage 267); and recirculating non-condensed residues of unreacted hydrogen back to the hydrogenation system (stage 268).

Method 200 may further comprise separating a vapor/gas mixture from hydrocarbon liquid phase at the vertical well head with subsequent light hydrogenate condensation and recirculation of non-condensed residues of unreacted hydrogen back to the hydrogenation system; releasing liquid hydrogenate from the remaining non-liquefied solid inert admixtures and its feed for further processing to a petroleum refinery; cleaning of the solid residue extracted from the heavy hydrogenate from the impregnating hydrocarbon liquid phase by an organic solvent and its further drying and removal out of the process; mixing of dry solid hydrogenation residue with dehydrated heavy product of the first stage of the original mineral grinding; cleaning of the final humid mechanical mixture of inert incombustible minerals from the catalyst residues with fresh water, and a subsequent squeezing of the moist waste product from an excessive liquid phase; evaporation of rinse water remaining after washing the mixture of solid waste products until the evaporated solution reaches the initial density (intermediate between those of the combustible mineral and mineral admixtures), and returning the regenerated water-mineral medium to the head of the process. In certain embodiments, method 200 further comprises any of the stages: separating the hydrogenation product into different phases (stage 272); removing residues from the product (stage 274); and further processing and refining the product (stage 275).

In certain embodiments, heavy waste products of the second and third stages of gravity beneficiation may be squeezed from excessive liquid phase and returned to wet grinding in the cycle of the first (cold) concentration stage. In the capacity of mineral salts catalyzing the hydrogenation process, only those water-soluble chemical compounds with a high catalytic activity, which are high soluble in water, allow preparing solutions on their basis, which have a density that is sufficient for floating combustible components of the initial rock mass, are used, and not just ionogenic inorganic substances facilitating the interaction of carbon-containing component of the combustible mineral with hydrogen. These water-soluble compounds may be selected to catalyze the hydrogenation process as well as to form aqueous solutions with the density intermediate between those of combustible mineral and waste rock are, e.g., certain mineral salts with high enough water solubility, such as zinc or tin chlorides or bromides, ammonium paramolybdates and tetramolybdates or iron sulfates, or else their mixtures. Water solubility of hydrogenation catalysts of this type is quite sufficient for preparing aqueous solutions with the density needed for floating of only combustible components of the original rock mass. For instance, 60%-solution of ferric iron sulfate $Fe_2(SO_4)_3$ at the temperature 17.5° C. has the density 1.798 g/cm$^3$, while the density of coal does not exceed, as a rule, the values of 1.319-1.546 g/cm$^3$. In other words, it is not necessary to use solutions highly saturated with the mineral component for coal floating. More dilute water-salt media are also applicable, for example, 40%-solution of the same ferric iron sulfate in water (its density at 17.5° C. equals 1.449 g/cm$^3$). Preparation of such solutions on the basis of water-soluble molybdenum-containing salts, e.g., ammonium paramolybdate or tetramolybdate, and introduction of other microadditives into the final mixture allow the water-salt medium not only to achieve the density required for coal floating, but also to increase catalytic activity of the formed compositions. In certain embodiments, the density of all principal rock-forming minerals (argillite, siltstone, limestone, quartzite, sandstone, anhydrite, granodiorite, feldspar, montmorillonite and other alumosilicates) is much higher (about 2.376-2.887 g/cm$^3$), which predetermines the absence of any possibility of their floating together with coal in such a relatively light (for them) liquid.

The paste-forming substance may comprise various compositions, e.g., products of petroleum processing, by-product coking or fine organic synthesis can be used, which contain thermally unstable organic substances (primarily, of aromatic series) that can serve as atomic hydrogen donors at their heating, e.g., tetralin mixture with anthracene oil diluted afterwards with isopropyl alcohol. However, not only paste-forming substance components can supply atomic hydrogen in the method of the invention, but also mineral salts used as the basis for the preparation (or introduced as impurity ingredients) of water-salt solutions for coal floating. For example, if a solution of a mineral salt as potassium formate highly soluble in water is used as the heavy liquid (when approaching the saturation state, its density reaches 1.570 g/cm$^3$ and more), this inorganic substance that has arrived to the hydrogenation stage together with the final extra-pure coal concentrate, thermally decomposes at heating above 360° C. into potassium oxalate and hydrogen. The latter, at the moment of its appearance, exists in the atomic form and is a very strong reducer drastically facilitating further bonding of hydrogen atoms to carbon atoms: $2HCOOK=(COOK)_2+2H^+$. Hence, certain embodiments utilize a unique combination of properties as found in potassium formate, namely that the density of HCOOK solution in water is greater than the density of coal, whereas upon heating this salt it decomposes with formation of atomic hydrogen, which leads to a sharp acceleration of the hydrogenation process.

Besides, in contrast to known solutions in the field of artificial liquid fuel production using dry methods of the initial mineral transportation from the mining face to the liquefaction site and conventional grinding processes, the delivery of newly-produced coal to its processing site by vertical floating with further additional wet grinding in the same water-mineral medium, whose density is intermediate between those of the combustible mineral and its incombustible components, not only combines the process of delivery (by the shortest route) from the mining site to the site of preparation for hydrogenation (simultaneously releasing it from the most part of waste rock), but also totally isolates the coaly substance from contact with air oxygen.

As a result, the absence of oxygen access to the coal surface leads to the prevention of its endogenous (invisible) oxidation, which negatively affects the completeness and velocity of the combustible mineral liquefaction (not to speak about hydrogen over-expenditure). Meanwhile, step-by-step grinding of the coal preliminarily beneficiated in the process of floating in the same water-salt solution, which precedes the hydrogenation stage, leads to automatic slipping of fragments of combustible mineral (as they get released from accretions with waste rock) from the hits of grinding bodies and, thus, to a decrease in ball load of the mills. In combination with the possibility to obtain artificial liquid fuel in underground conditions, with a spontaneous recuperation of gratuitous heat of the Earth interior for primary heating of the participants of hydrogenation interaction (due to elevated temperatures characteristic of bearing strata at large depth) and to reject high-lift pumps (which are the main consumers of electric power at coal liquefaction in ground-surface conditions) for introducing the original coal-oil paste into the hydrogenation process, the invention ensures a higher level of energy perfection of the processing of the produced solid fuel into artificial petroleum in comparison with known ground-surface technologies of obtaining synthetic liquid fuel from various combustible minerals.

Advantageously, the total decrease of the volume of technological flow fed to the hydrogenation stage, which must be heated to the reaction temperature, and the reduction of power consumption connected with further separation of liquid products from solid inert admixtures removed from the liquefaction process by the artificial petroleum, may ensure both an additional significant reduction of energy consumption for producing artificial liquid fuel according to the invention, and a radical weakening of harmful influence of the disclosed technological process on natural environment. Besides, capturing of methane and other combustible gases may accompany all the processes of size reduction and ensure complex usage of valuable power resources contained in the original mineral. Thus, all the features of the present invention may be interconnected, and their combination may allow the achievement of the above mentioned advantages.

Example

As a non-limiting example, the following detailed system plan illustrates realization embodiments of the invention described above. In this non-limiting example, coal may be processed as the combustible material. All values mentioned below are non-limiting examples and may be modified and adapted according to different types of combustible material, different configuration of the processing units and fluids.

Floating subsystem 210A may be arranged to gravitationally separate the combustible material from waste rock in an aqueous salt solution selected to have a density which is intermediate between a density of the combustible material and a density of the waste rock.

Freshly produced lump coal or other combustible material 90 from the mining face is subjected to preliminary screening by size on sieve 101. Lumps of the initial mineral that have passed through the sieve are fed to further processing, while the oversize material is crushed in crusher 102 and then added to the undersize through-product of screening. Both sieve 101 and crusher 102 are enclosed into hermetic casings in rarefaction created in the system of methane capturing (not shown). Raw combustible material 90 is thus turned into prepared combustible material 90A.

Combustible material 90A prepared by size in this way (the size of the biggest lump of crushed rock mass not exceeding a half of the diameter of vertical pipeline 105 for coal floating) is charged into one of legs 103 of the locking mechanism of the initial feeding of the system of hydrostatic hoist of coal liquefaction facility.

Then, the charged material is pressurized in the chamber by rotating gate 104 into right-hand position pressed to vertical column 105, and flooded (e.g., by opening lateral taps in the upper and lower parts of column 105) with aqueous solution 80 of mineral salt, which may be used to float combustible material 90A and sink waste rock 89, and may also operate as a catalyst for the subsequent hydrogenation process. The air pressed out of this hermetic volume is released through air valves (not shown).

Examples for aqueous salt solution may comprise 40%-solution of zinc chloride in water with the density 1.423 g/cm$^3$ (at 25° C.) with ammonium paramolybdate admixture is used as water-salt medium for the realization of the technological process. However, other mineral salts and their various mixtures, such as nanoaqueous ferric iron sulfate $Fe_2(SO_4)_3.9H_2O$, ammonium paramolybdate $(NH_4)_6Mo_7O_{24}.4H_2O$, ammonium tetramolybdate $(NH_4)_2.4MoO_3.2H_2O$, iron vitriol $FeSO_4.7H_2O$, bivalent tin chloride $SnCl_2$, a mixture of nanoaqueous ferric iron sulfate $Fe_2(SO_4)_3.9H_2O$ with penta-aqueous chloride of quadrivalent tin $SnCl_4.5H_2O$ (used in a 3:1 weight ratio), zinc bromide, etc., can be used as such inorganic compound possessing the set of properties necessary for the realization of the process of the invention.

In certain embodiments, aqueous salt solution 80 may also comprise oxidized forms of various metals of variable valency, such as iron, nickel, cobalt, molybdenum, tin, aluminum, silicon oxides, as well as tungsten, molybdenum, sodium, potassium, nickel and iron sulfides with the addition of elementary sulfur, and various multi-component compositions on their basis, as well as sulfates and halides of certain metals or ammonium salts of isopolimolybdenum and thiomolybdenum acids and other chemical compounds which are capable to accelerate the hydrogenation process or to deliver atomic hydrogen and hence be used as catalysts of the combustible minerals liquefaction described below.

Densities of aqueous solutions 80 of the mineral salts catalyzing the process of the coaly substance hydrogenation exceed the density of the respective kinds of solid fuel, which predetermines the possibility of the combustible mineral floating in it. Meanwhile, waste rock 89, which is heavier than coal, sinks in medium 80, which allows combining vertical delivery of coal to the site of its further processing with simultaneous preliminary beneficiation.

Then, smoothly turning the central gate 104 into the right-hand position, the internal volume of left leg 103 is combined with the contents of vertical column 105 into a vertical column of water-salt medium with the density exceeding that of coal. It leads to the floating of the next portion of coal 90A from the mine to the ground surface, while waste rock 89, which is heavier than zinc chloride solution 80, sinks in liquid 80 and thickens at the discharging nipple of the charging facility.

Combustible material 90A such as coal floats in water-salt solution 80 and is accumulated in the form of a loose cap in the upper (broadening) part of column 105, wherefrom it is fed to the first stage of grinding realized in the same water-salt medium flooding ball mill 106, whereas the waste rock sunk in liquid 80 is discharged through the locking system into thickener 107. These are the first units of milling subsystem 230A arranged to successively reduce a particle size of separated combustible material 90A in solution 80 and to remove residual waste rock and gas therefrom (see below).

Waste material 89 is treated in sank waste treatment subsystem 220A, e.g., thickened in a thickener 107 and squeezed from the liquid in filtering centrifuge 108 and then discharged into band vacuum filter 109, where it is squeezed (together with other solid wastes of the process, see below) from water-salt liquid phase, rinsed with fresh water in the countercurrent mode and fed to the grinding in hermetic mill 110. In the course of outcropping of new surfaces of the ground material, methane released into the gaseous phase is sucked out of the mill Waste material 89, which is ground and released from methane, is arranged in the worked-out space. This prevents the development of geomechanical processes of movement of the overlying strata of rocks, which entail an irreparable damage to all ground-surface objects located at the territory undermined by underground mining, from the consequences of the ground surface subsidence. Meanwhile, aqueous solution 80A of zinc chloride clarified from the waste rock is returned by piston pump 111 to the system of hydrostatic coal hoisting system.

In milling subsystem 230A, further grinding of combustible material 90B is carried out. Combustible material 90B is the floated material 90A which was preliminarily released from the most part of waste rock 89 in the process of its floating up (as combustible material 90A). The further grinding is accomplished in ball mill 106 in the same water-salt medium 80. While coal is released out of its accretions with waste rock by the milling, fragments of the coaly substance are not subjected to further destruction and remain afloat on the surface of liquid medium 80, while all other components of the original raw material are submerges again into the zone of the impact of milling bodies. As a result, with crushing of floated combustible material 90A by steel balls continuously rolling in the drum of mill 106, fragments of pure coil appearing in the course of the milling process, irrespective of the extent of their crushing, float up to the surface of liquid 80, automatically avoiding, in this way, energy over-expenditure for their additional over-crushing, which entails the efficiency of subsequent separation and growth of the beneficiation products humidity.

Additional methane may be discharged into the gaseous phase (like other gaseous hydrocarbons), which is practically water-insoluble. The gases bubble through the layer of water-salt solution 80 (within mill 106) and then gets into the system for capturing it, wherefrom it is fed to catalytic conversion with water vapor in order to obtain hydrogen needed for coal hydrogenation. The excess of this energy carrier is sold to exterior consumers as gaseous fuel.

The discharge of mill 106 is delivered to sump 112 equipped with a mixer, wherefrom it is fed by pump 113 to hydrocyclone 114, where coal is more intensely (as compared with mill 106) separated from incombustible inert admixtures, which are much heavier minerals forming the part of the original energy mineral. The light product (crude coal concentrate) of the first separation cycle coming out of the upper axial nipple of the cylindrical part of hydrocyclone 114, is delivered to vapor-heated container 115 (heated by vapor 91A) equipped with a mixer, being part a heating and further milling subsystem 240A. As a result of heating, the density of the liquid phase of the suspension drops e.g., from 1.423 (at 25° C.) to 1.403 g/cm$^3$ (at 50° C.). The lowered density improves the separation capability of solution 80 as it can separate waste rock which is closer in density to the combustible material.

To achieve a more complete opening of accretions, the material flow may be fed to the second stage of grinding. This process is realized in a moderately warm mode in a drum ball mill 116, which is also connected by its end-face with methane collector, but, in contrast to mill 106, is covered with a thick layer of thermal insulation. The heavy waste product of the first grinding stage coming out of the head of conical part of hydrocyclone 114 is hydromechanically squeezed from liquid phase excess on a filtering centrifuge 117 and supplied to mixer 118 for mixing with the solid residue extracted in the tail of the technological system of coal liquefaction from heavy hydrogenate. The denser part of the mixture separated by filtering centrifuge 117 is returned to the first separation cycle for mixing with the product for further grinding, which comes out of mill 106. The discharge flow from mill 116 (similarly to the discharge of mill 106) is also fed, from thermally insulated sump 119 equipped with a mixer, by a pump 120, to separation realized in hydrocyclone 121 covered with thermal insulation (to avoid the return of the liquid phase density to its original value, at which the first stage of grinding and separation was realized).

Heated grinding subsystem 240B is arranged to heat and grind the combustible material of reduced particle size (90C) to yield a paste (90E) of purified combustible material. The light fraction discharged from the upper axial nipple of the cylindrical part of hydrocyclone 121 is fed to container 122 equipped with a mixer and heated by vapor 91B, where the technological flow is heated to 90-95° C., which leads to a further decrease in the density of zinc chloride solution in water from 1.403 to 1.354 g/cm$^3$ and a drop of its viscosity, respectively, from 2.469 (25° C.) and 1.454 (50° C.) to 0.727 centipoise (note that it is much below the fresh water viscosity). Further grinding of this crude coal concentrate is accomplished in vibromill (vibratory grinding mill) 123, which is also thermally insulated.

After that, the final precision beneficiation of coal is realized in a strong centrifugal field of settling centrifuge 124 covered with thermal insulation. The high efficiency of the centrifugal separation in a strong centrifugal field of settling centrifuge 124 is due not only to the fact that the stratification of minerals being separated occurs in a heavy medium with anomalously low viscosity. In contrast to separation in hydrocyclones 114 and 121, the stratification of the original mixture of minerals in fast settling centrifuge 124 is realized in a motionless liquid, which is at rest with respect to the rotating vessel it is in, with which it rotates around the horizontal axis, and not in a turbulent rotating flow. The heavy, but non-viscous liquid, which is at rest with respect to the rotor of centrifuge 124, rotates inside the centrifugal separator at the same velocity as the bucket rotating around its longitudinal horizontal axis at a huge angular velocity. As a result, inside the centrifuge rotor, a motionless liquid sleeve in the form of annular solid of rotation arises, and the extra-pure coal concentrate floats up to its internal cylindrical surface. Advantageously, the separation factor can reach values which are much higher than separation values achieved in the conditions of minerals stratification in hydrocyclones (and even more so with respect to static conditions), since rotation velocities of the centrifugal separators reach thousands revolutions per minute. Besides, in any hydrocyclone, liquid moves along a trajectory swirling with respect to its motionless wall. This causes additional head loss of the turbulent flow due to a large touch area of rubbing liquid and solid surfaces, not to speak about a considerable erosion of the casing of the separation facility.

Coaly material of extra-high purity, which is wholly free from visible mineral admixtures and represents the product of the third, precision stage of coal beneficiation (heated grinding subsystem 240B), is carried out as the light material separated by settling centrifuge 124. Meanwhile, the discharged cake (heavy material) representing a waste product of centrifugal beneficiation and containing last traces of the combustible substance is returned to the head of the beneficiating part of the process by elevator 125 (equipped with a cooling jacket and a fan for cooling the transported material down to ambient temperature) for mixing with input technological flow entering mill 106 of the first, cold grinding cycle.

A deep squeeze and paste formation subsystem 240C carries out the final deep squeezing of the extra-pure product of the third separation stage by delivering the lighter material of settling centrifuge 124 into filtering centrifuge 126. After that, the obtained transparent hot water-mineral medium is returned by pump 128 from thermally insulated sump 127 to container 122. Wet coal cake 90D impregnated with aqueous solution of zinc chloride (80) is fed into screw mixer 129 heated by blind vapor 91C for mixing with a hot (140-190° C.) paste-forming substance 70 comprising, e.g., tetralin (1,2,3,4-tetrahydronaphthalene—$C_{10}H_{12}$) with an admixture of anthracene oil (a fraction of coal-tar resin boiling within the range 270-360° C.), and a micro-admixture of elementary sulfur. Screw mixer 129 with paste-forming substance 70 thus turns the wet cake of combustible material 90D into a combustible material paste 90E. However, not only paste formation occurs, but additionally, extra-pure coal concentrate 90D is released from excessive aqueous moisture (boiling at a high temperature, and as a result, screw mixer 129 operates under rarefaction), and final residues of aqueous solution containing mineral salts catalyzing the hydrogenation process with the formation of micro-drops of the catalyst, are emulsified. Water vapors formed in the course of the process are disposed to the condensation.

A paste fluidizing subsystem 250A is arranged to fluidize paste 90E. The consistency of the homogeneous pasty mass 90E prepared in screw mixer 129 is corrected in mixer 130 by admixing a diluting fluid 60 such as isopropyl alcohol (isopropanol $CH_3CHOHCH_3$), or by mixing with some other organic solvent and delivered to disperser 131. There, the solid phase of the coal-oil mixture is additionally rubbed in a strong centrifugal field down to the colloidal size, simultaneously emulsifying the catalyst even more finely, to yield fluidized combustible material 90F. The extra-pure coal concentrate is thereby deeply cleaned from mineral admixtures and rubbed in disperser 131 to an extra-fine state, in the form of easy-to-move hot coal/oil mixture 90F, which is delivered as a solid stream by guiding nipple 132 submerged into this slush into receiving cone 132 of hydrogenation subsystem 260A.

Hydrogenation subsystem 260A is arranged to hydrogenate fluidized paste 90F, e.g., in a vertical pipe (134) ending below with a T-joint with oppositely directed nozzles (137) forming a reactive turbine—the Segner wheel. In certain embodiments, hydrogenation subsystem 260A comprises a vertical shaft 134 arranged to receive the fluidized paste and maintain a downwards flow 90F thereof; a Segner turbine 136 in fluid communication with vertical shaft 134 and arranged to be rotated by flowing fluidized paste 90F (by releasing fluidized paste 90F through nozzles 137); a hydrogenation chamber 138 (also termed blind pit 138 in the following) enclosing a bottom portion of vertical shaft 134 and Segner turbine 136. Hydrogenation chamber 138 further comprises a heating unit 139 arranged to heat fluidized paste 90F and 90G (see below) and a hydrogen supply 140 arranged to introduce hydrogen 50 into fluidized paste 90F that exits Segner turbine 136, to hydrogenate the fluidized paste. Hydrogenation subsystem 260A further comprises a vertical enclosure 135 in fluid communication with hydrogenation chamber 138 and arranged to maintain an upwards flow 90G of the hydrogenated fluidized paste from hydrogenation chamber 138 while enabling recuperative heat exchange between rising hydrogenated fluidized paste 90G and downwards flow of fluidized paste 90F.

Some embodiments of the invention comprise a hydrogenation unit 260A comprising: a vertical shaft 134 arranged to receive a fluid combustible material 90F and maintain a downwards flow thereof; a Segner turbine 136 in fluid communication with vertical shaft 134 and arranged to be rotated by the flowing fluid combustible material; a hydrogenation chamber 138 enclosing a bottom portion of vertical shaft 134 and Segner turbine 138. Hydrogenation chamber 138 comprises heating unit 139 arranged to heat the fluid combustible material and hydrogen supply 140 arranged to introduce hydrogen into the fluid combustible material that exits Segner turbine 138, to yield a hydrogenated combustible fluid. Hydrogenation subsystem 260A further comprises a vertical enclosure 135 in fluid communication with hydrogenation chamber 138 and arranged to maintain upwards flow 90G of the hydrogenated combustible fluid from hydrogenation chamber 138 while enabling recuperative heat exchange between rising hydrogenated combustible fluid 90G and downwards flow of fluid combustible material 90F. It is explicitly noted that hydrogenation unit 260A may be part of system 100 or may be an independent unit, receiving fluid combustible material from any source and delivering hydrogenated combustible fluid to any further processing facility. In certain embodiments, vertical shaft 134 and vertical enclosure 138 are at least one kilometer long and Segner turbine 138 is in an underground mine for combustible material that is used to generate the fluid combustible material. A more detailed description of hydrogenation unit/subsystem 260A is presented below.

Cone 133 is the upper part of rotating vertical pipe 134 ending below with the T-joint at the bottom of Segner turbine 136 (having oppositely directed nozzles 137 forming the reactive turbine—the Segner wheel. Thus, the slippery coal/oil mixture 90F supplied for hydrogenation is, simultaneously, the working medium of the mixing hydromechanic facility. However, some embodiments of the invention may comprise other hydrogenation subsystems 250A. Rotating vertical pipe 134 supplying this flow for hydrogenation is concentrically inserted into vertical well 135 which ends with blind pit 138—a vertical excavation protected from inside against rock pressure by a hermetic tub.

Owing to the reaction of high-pressure jets of mobile hot coal/oil mixture flowing out of these nozzles 137, the rotation of the entire hollow vertical shaft enclosing column of coal/oil mixture 90F about thousand and more meters high around its axis is realized. If spinning to even higher angular velocities is needed, the mixer in blind pit 138 can be set to rotation using an additional electric drive. Here, a hydrostatic pressure reaching a hundred atmospheres and more is spontaneously generated in blind pit 138. Its value depends on the depth of underground mining and the height of the well head above the ground surface. Since modern coal mines have already reached the depth of 1200-1400 meters (the record depth being 2042 meters), and the average level of underground mining around the world is steadily decreasing, even at the depth of 1100-1300 meters, the pressure of a vertical column of the coal-weighted mobile hot slush 90F reaches, in a natural way, the values on the order of 10-12 MPa at the base of blind pit 138 without external energy consumption. Such relatively high pressure is quite sufficient for highly efficient liquefaction of coaly substance 90F using a number of highly active catalysts prepared on the basis of water-soluble inorganic compounds (including molybdenum-containing ones, originating, e.g., from solution 80). Besides, the temperature of enclosing rocks at such depths is not subject to daily or seasonal fluctuations and is elevated in comparison with meteorological conditions in the working zone of coal liquefaction in ground-surface conditions, especially in winter. Although the gratuitous use of the heat of the Earth's interior allows a certain reduction of energy consumption in the described processes, temperatures of about 45-55° C. are obviously insufficient for thermal destruction of complex molecules in combustible material 90F and, thus, initiation of the interaction of excited carbon atoms with hydrogen.

Blind pit 138 may be equipped with heat-exchange coil 139 with a high-temperature heat carrier circulating in it, which maintains the temperature in the zone of hydrogenation reaction at the level of 390-420° C. Hydrogen supply 50 into the zone of coal hydrogenation is realized using a vertical set of bubblers 140 installed on the periphery of blind pit 138 in such a way that jets of gas 50 are introduced tangentially to the internal side wall of the hollow cylinder. At the temperature of 390-420° C. and pressure 10-12 MPa, in the presence of zinc chloride with the admixture of ammonium paramolybdate and elementary sulfur as catalyst (originating, e.g., from solution 80 and from paste-forming substance 70), carbon contained in the original mineral actively reacts both with molecular hydrogen (supplied into blind pit 138 in the hot state from the facility for the conversion of methane capped from the original raw material in the course of its size reduction) and participates in the reaction of hydrogenation of coaly substance 90F by atomic hydrogen split off from the components of paste-forming substance (primarily, tetralin), which reveals, in this connection, an elevated reactionary activity.

Hot hydrogen 50 may be supplied from a system of methane conversion and introduced under a high pressure into blind pit 138 tangentially to its internal cylindrical surface through several connection pipes arranged at various height levels, to ensure not only a fine control of the thermal regime of hydrogenation, but also to be used as a mixing agent. Since the height mark of the site of the original flow feed to hydrogenation exceeds the level of the discharge of the produced mixture of hydrocarbons (90G) rising along the annular gap between well 135 and axial pipe 134, artificial petroleum obtained as a result of hydrogenation reaction gets into the empty space of the broadened part of the head of well 135.

In the course of the counterflow of the material flows 90F, 90G, a recuperative heat exchange occurs between the hot artificial petroleum 90G rising from blind pit 138 and fresh coal/oil mixture descending in the opposite direction along the axial pipe 134. The mixture of hydrocarbons 90G that has ascended from the hydrogenation zone in blind pit 138 and reached the ground surface enters separator 141, which is a ground-surface head of well 135 and represents a hollow vertical hermetic vessel in the form of an upside-down can. The main product of the process is collected as combustible fluid and hydrogenated material 90H. The vapor/gaseous phase of product 90H may be separated from liquid products thereof and further processed. The obtained vapor/gas mixture may be supplied from hot separator 141 through nozzle 142 to processing, and as a result, the unreacted hydrogen (as a gas that cannot condense in this system) may be returned to blind pit 138 for its repeated use in the hydrogenation process. The gases dissolved in rising liquid 90G may be discharged due to the pressure drop above the surface. The vapor/gas mixture discharged from this hydrocarbon liquid may be fed to the recuperation of its heat to corresponding external heat-exchange equipment (not shown). After that, it may be directed to a cold separator (not shown) for cooling, condensation and subsequent separation with a discharge of hydrogen-containing recirculation gas returned into the process and a light condensed hydrogenate.

Final cleaning and processing of the residues of the hydrogenation product, after combustible fluid and hydrogenated material 90H has been separated from it, may be carried out in a residue purification and separation subsystem 220B. The liquid mixture of high-boiling hydrogenation residual products (89B), while being released from the dissolved gases and liquid combustible material, may be still contaminated by residues of solid non-liquefied material. Mixture 89B is discharged from the lower part of separator 141 into refrigerator 144 by lateral nozzle 143 and is accumulated in thickener 145, wherefrom the condensed sludge is fed to deep squeezing of the impregnating liquid phase into a filtering centrifuge of periodic action 146.

The cake periodically squeezed on centrifuge 146 is cleaned on it (in a periodic mode, too) from the last impregnating residues of the heavy hydrogenate with an organic solvent 40, e.g., petroleum-ether (a mixture of light hydrocarbons, predominantly saturated, with five and six carbon atoms). Then, it passes through drier 147 to yield a residual product 90I and waste 89C which is recharged onto belt conveyor 148, which transports this wastage into mixer 118 for mixing with the moist heavy product removed out of the initial energy mineral as early as at the first stage of its grinding. The discharge of thickener 145 is combined with the filtrate of centrifuge 146, and the obtained in this way heavy hydrogenate, which is already completely free from the solid phase, is directed to further processing, which is performed, however, at a petroleum distillation plant.

Waste treatment subsystem 220A may receive waste material from all stages of the process, e.g., waste 89 from floating separation subsystem 210A, waste 89A from milling and grinding subsystems 230A, 240A, 240B, 240C, and also waste 89C from residue purification and separation subsystem 220B. Moist mixture of solid wastes obtained in mixer 118 is cleaned with hot fresh water from last residues of mineral salts carried out of the technological process by means of multi-stage countercurrent washing on band vacuum-filter 109, ground in hermetic mill 110 (simultaneously capturing methane). Then, it is removed out of the production cycle and arranged in the worked-out space as a cheap backfilling material. Rinse water obtained in the process of countercurrent washing, which represents a dilute solution of zinc chloride in water with an admixture of molybdenum-containing compounds, is directed from sump 149 by pump 150 to evaporator system 151 for evaporation. Thin water vapor released in the course of evaporation of the solution is liquefied in condenser 152. The obtained fresh hot condensate is returned to the first stage of countercurrent washing of solid waste on band vacuum filter 109. Aqueous solution of zinc chloride with the remaining admixtures of molybdenum-containing compounds, which was restored to the required original density of 1.423 g/cm$^3$ by evaporation, is removed by pump 111 from the internal circulation loop of evaporator system 151 to the head of the process, i.e., to the system of hydrostatic coal hoisting. Thus, the production cycle of zinc chloride and molybdenum-containing compounds used as aqueous salt solution 80 in the process, as well as the production cycle of mineral salts catalyzing the hydrogenation process, may be practically closed. At proper production standards, irreversible losses of these substances are minor.

Hence, advantageously, the methods and systems described above in the coal-mining industry for producing artificial liquid fuel in underground conditions are power-saving and ecologically clean, and their use may contribute to an essential increase in technical and economic efficiency of processing combustive minerals, especially those notable for elevated contents of incombustible mineral admixtures. At the same time, the extraction of complex materials is ensured (at the expense of associated methane extraction out of the original raw material), and the liquefaction may be complete (due to elevated purity of coal concentrate supplied for hydrogenation, which is, besides, thoroughly impregnated by the catalyst of hydrogenation process and has not been in contact with air oxygen in the process of its transportation and grinding). This reduces the specific consumption of the original solid energy mineral per ton of the obtained liquid product. Besides, harmful impact of underground mining and artificial liquid fuel production on the natural environment is essentially weakened, because all the waste of such an enterprise is arranged in the underground worked-out space. Moreover, the discharge of ready product—artificial petroleum produced by coal mines in underground conditions—instead of drawing non-beneficiated solid fuel to the ground surface, allow not only to cancel such powerful electric power consumers as cable-skip hoists (the power of electric drives of modern mine hoists reaches 15,000 kW) and coal cleaning plants (total electric power of drives at the ground-surface facilities can reach 10,000 kW) from the mine equipment, but also completely reject the services of railway transport. In this case, it is much more profitable to deliver the product to its destinations by pipeline transport, which is about three times cheaper than railway transport (not to mention mechanical losses of solid fuel because of coal dust blown out of railway cars by wind.

Advantageously, the disclosed methods and systems may be of special interest for deep and extra-deep deposits of energy minerals. For example, today, record depths reached by coal-mining industry approach 2000 meters. Coal liquefaction at such extreme depths leads to the growth of working pressure in the zone of its hydrogenation up to 21-22 MPa (without attracting power inputs from outside), which considerably intensifies such underground technological process and drastically facilitates the conversion of even the most carbonized kinds of combustible minerals into artificial petroleum. However, according to modern geological science, coal series stretch to much greater depths, which opens the prospects of the development of these huge stores of energy minerals not for producing solid fuel, but for mining industry conversion from coal to ecologically clean production of synthetic liquid fuel. The steady growth of temperature of enclosing strata with the deepening level of underground mining allows a considerable increase of the share of gratuitous heat of the Earth interior in the total energy balance of the technological process. Furthermore, the saturation of coal and enclosing strata with methane sharply grows with increasing depth of coal strata occurrence.

Therefore, the possibility of complex usage of the power potential of the produced raw material with simultaneous extraction of methane advantageously distinguishes the method of the invention from known technologies of solid fuel processing into alternative energy carriers. A reduced requirement for hydrogen also contributes to the profitability of underground coal liquefaction in comparison with ground-surface production of artificial liquid fuel. The point is that the freshly produced energy mineral obtained from the mining face is immediately isolated from the mine atmosphere by operative submersion into water-salt medium. Thus, the atmospheric oxygen loses contact with the coaly component of the combustible mineral and initiates the mechanism of its endogenic oxidation. On the whole, the main advantage of the technological process of the invention is a steady increase of technical and economic efficiency of underground coal liquefaction, whereas conventional approaches to the production of artificial liquid fuel (having the coal liquefaction system on the ground surface) lead to irreversible growth of the prime cost of the produced artificial liquid fuel and to harmful impact of such industrial activity on the natural environment, as the underground mining reaches greater depths.

In certain embodiments, the method of combustible minerals processing comprises preliminary preparation of the original raw material by size with its subsequent gravity concentration, mixing of the obtained concentrate with paste-forming substance and coaly substance hydrogenation in a hot mode under elevated pressure, completed by the separation of a mixture of liquid products of liquefaction from the remaining solid inert residue. After the preliminary preparation of the original raw material by size realized in underground conditions, the ground material is charged into a column of liquid medium with the density intermediate between those of the combustible mineral and the waste rock prepared by water dissolving of mineral salts exerting a catalytic impact on further hydrogenation of the produced combustible mineral. Subsequently, a step-by-step wet grinding and gravity concentration of dressed material floated to the ground surface is carried out in the same water-salt medium within the framework of a three-stage dressing. Then, the obtained final concentrate is mixed with paste-forming substance, diluted with an organic solvent, rubbed to the colloidal size and fed by a hollow rotating shaft installed in the vertical well, which ends with Segner wheel, to hydrogenation in a blind pit. The hydrogenate that rises along the annular gap between the hollow rotating shaft and the vertical well is released from gases dissolved in it, separated from the solid residue, and the product of combustible mineral liquefaction is brought out to distillation into fractions.

In certain embodiments, the waste rock sunk after its charging into the column of water-salt medium is squeezed from the liquid phase, rinsed with water and ground, simultaneously capturing methane released into the gaseous phase in the course of said waste rock size reduction, whereupon it is laid into the worked-out space.

In certain embodiments, the method further comprises grinding of the floated material within the first stage of the dressing cascade is carried out at the ambient temperature in the same solution, with simultaneous capturing of the released methane, in a mill functioning within a closed cycle with the separator of the combustible mineral.

In certain embodiments, the product of the first stage of the dressing cascade roiled in water-salt solution is heated and additionally ground with simultaneous capturing of the released methane at the second stage of the dressing cascade, at the same time with its further separation under the conditions of moderate heating.

In certain embodiments, the obtained technological flow of the second stage of the dressing cascade is heated at the third stage of the dressing cascade to an even higher temperature not reaching the boiling point of the water-salt medium, whereupon its solid phase is additionally ground to the extra-fine state and, finally, precisely separated from the last residues of visible mineral admixtures in a strong centrifugal field in a hot technological mode.

In certain embodiments, waste products of the second and third stages of gravitational dressing are squeezed from the liquid phase excess and returned to wet grinding into the cycle of the first stage of the dressing cascade, with a subsequent removal out of the process together with the waste product of the first stage of the dressing cascade.

In certain embodiments, the solid residue separated from the product of the combustible mineral liquefaction is cleaned from the impregnating mixture of hydrocarbons with an organic solvent, dried and mixed with dehydrated waste product of the first stage of the dressing cascade mixed with the waste of the second and third stages of dressing, whereupon the obtained mixture of inert minerals is rinsed with fresh water together with the waste rock sunk in the column of water-salt medium, after charging the original crushed raw material into the latter.

In certain embodiments, the rinsing water remained after cleaning the process waste is evaporated to its original density and returned to the head of the process.

In certain embodiments, the mineral salts used for preparing water-salt medium with the density intermediate between those of the combustible mineral and waste rock, may comprise individual inorganic compounds and/or their mixtures, such as zinc or tin chlorides or bromides, various iron sulfates, ammonium salts of molybdenum acids, as well as potassium formate, which exert later a positive influence on the hydrogenation process either by their catalytic effect or by atomic hydrogen detachment.

In certain embodiments, the paste-forming agent for preparing coal/oil mixture supplied to hydrogenation, may comprise organic compounds of the aromatic series, which can serve as atomic hydrogen donors, e.g., tetralin, methyl naphthalene, quinoline mixture with phenol, cresol, naphthalene solution in phenol, technical anthracene and other components of anthracene oil.

In certain embodiments, the solvent of coal/oil mixture for correcting its consistency may comprise petroleum processing products and/or individual organic compounds and their mixtures obtained by synthetic means, such as isopropanol and other alcohols.

It is noted that certain embodiments of the present invention overcome much of the transport problems of known technology by carrying out the liquefaction underground, in proximity to the actual production of the combustible material. The underground location also removes many of the environmental hazards presented by known technologies. Moreover, the separation of combustible material by floating solves both a delivery problem as well as the waste rock removal problem, as the latter may simply be returned to the underground mine after the processing described above. Finally, the energy requirements are significantly reduced by using the Segner turbine rotated by the material flow and utilizing the heat and pressures provided by the underground location of the hydrogenation chamber. The processes may be designed, as illustrated above, to involve maximal recycling of liquids that are used in the process, use hydrogen extracted from the combustible material for the hydrogenation and minimize energy consumption while maximizing the liquefaction efficiency.

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A system for processing combustible material, comprising:

a floating subsystem arranged to gravitationally separate the combustible material from waste rock in an aqueous salt solution selected to have a density which is intermediate between a density of the combustible material and a density of the waste rock;

a heated grinding subsystem arranged to heat and grind the separated combustible material to yield a paste of purified combustible material;

a paste fluidizing subsystem arranged to fluidize the paste; and a hydrogenation subsystem comprising a Segner turbine and arranged to hydrogenate the fluidized paste.

2. The system of claim 1, further comprising a milling subsystem arranged to successively reduce a particle size of the separated combustible material in the solution and to remove residual waste rock and gas therefrom, wherein the heated grinding subsystem is arranged to heat and grind the combustible material of reduced particle size to yield the paste.

3. The system of claim 2, wherein the particle size reduction is carried out within the aqueous salt solution.

4. The system of claim 1, further comprising a residue purification and separation subsystem arranged to separate additional product from residues of the hydrogenated material.

5. The system of claim 1, wherein the floating subsystem is arranged to receive the combustible material within an underground mine and wherein the hydrogenation subsystem is arranged to carry out the hydrogenation within the underground mine.

6. The system of claim 1, wherein the aqueous salt solution comprises at least one of: potassium formate, zinc chloride, ammonium paramolybdate, nanoaqueous ferric iron sulfate ($Fe_2(SO_4)_3.9H_2O$), ammonium paramolybdate ($(NH_4)_6MO_7O_{24}.4H_2O$), ammonium tetramolybdate ($(NH_4)_2.4MO_3.2H_2O$), iron vitriol ($FeSO_4.7H_2O$), bivalent tin chloride $SnCl_2$, with penta-aqueous chloride of quadrivalent tin ($SnCl_4.5H_2O$), zinc bromide, and mixtures thereof.

7. The system of claim 1, wherein the heated grinding subsystem applies an aromatic paste forming agent to yield the paste, the paste forming agent comprising at least one of: tetralin, methyl naphthalene, quinoline mixture with phenol, cresol, naphthalene solution in phenol, anthracene and components of anthracene oil.

8. The system of claim 1, wherein the hydrogenation subsystem comprises:

a vertical shaft arranged to receive the fluidized paste and maintain a downwards flow thereof;

the Segner turbine, being in fluid communication with the vertical shaft and arranged to be rotated by the flowing fluidized paste;

a hydrogenation chamber enclosing a bottom portion of the vertical shaft and the Segner turbine, the hydrogenation chamber comprising a heating unit arranged to heat the fluidized paste and a hydrogen supply arranged to introduce hydrogen into the fluidized paste that exits the Segner turbine, to hydrogenate the fluidized paste; and a vertical enclosure in fluid communication with the hydrogenation chamber and arranged to maintain an upwards flow of the hydrogenated fluidized paste from the hydrogenation chamber while enabling recuperative heat exchange between the rising hydrogenated fluidized paste and the downwards flow of fluidized paste.

9. A hydrogenation unit comprising:

a vertical shaft arranged to receive a fluid combustible material and maintain a downwards flow thereof;

a Segner turbine in fluid communication with the vertical shaft and arranged to be rotated by the flowing fluid combustible material;

a hydrogenation chamber enclosing a bottom portion of the vertical shaft and the Segner turbine, the hydrogenation chamber comprising a heating unit arranged to heat the fluid combustible material and a hydrogen supply arranged to introduce hydrogen into the fluid combustible material that exits the Segner turbine, to yield a hydrogenated combustible fluid; and a vertical enclosure in fluid communication with the hydrogenation chamber and arranged to maintain an upwards flow of the hydrogenated combustible fluid from the hydrogenation chamber while enabling recuperative heat exchange between the rising hydrogenated combustible fluid and the downwards flow of fluid combustible material.

10. The hydrogenation unit of claim 9, wherein the vertical shaft and the vertical enclosure are at least one kilometer long and the Segner turbine is in an underground mine for combustible material that is used to generate the fluid combustible material.

11. A method of processing combustible material in the system of claim 1, the method comprising:

separating the combustible material from waste rock gravitationally in an aqueous salt solution selected to have a density which is intermediate between a density of the combustible material and a density of the waste rock;

heating and grinding the separated combustible material to yield a paste of purified combustible material;

fluidizing the paste; and hydrogenating the fluidized paste by a Segner turbine.

12. The method of claim 11, further comprising successively reducing particle size of the separated combustible material in the solution and removing residual waste rock and gas therefrom, wherein the heating and grinding comprises heating and grinding the combustible material of reduced particle size.

13. The method of claim 12, further comprising recycling the aqueous salt solution which is removed in the separating and in the successive particle size reduction.

14. The method of claim 12, wherein the aqueous salt solution is selected to catalyze the separating and the successive particle size reduction.

15. The method of claim 12, wherein the successive particle size reduction is carried out within the aqueous salt solution.

16. The method of claim 11, further comprising processing the hydrogenated paste to yield hydrocarbons of specified compositions.

17. The method of claim 11, wherein the aqueous salt solution comprises at least one of: potassium formate, zinc chloride, ammonium paramolybdate, nanoaqueous ferric iron sulfate ($Fe_2(SO_4)_3.9H_2O$), ammonium paramolybdate ($(NH_4)_6MO_7O_{24}.4H_2O$), ammonium tetramolybdate ($(NH_4)_2.4MO_3.2H_2O$), iron vitriol ($FeSO_4.7H_2O$), bivalent tin chloride $SnCl_2$, with penta-aqueous chloride of quadrivalent tin ($SnCl_4.5H_2O$), zinc bromide, and mixtures thereof.

18. The method of claim 1, further comprising using an aromatic paste forming agent to yield the paste.

19. The method of claim 18, wherein the paste forming agent comprises at least one of: tetralin, methyl naphthalene, quinoline mixture with phenol, cresol, naphthalene solution in phenol, anthracene and components of anthracene oil.

20. The method of claim 1, wherein the fluidizing is carried out by mixing the paste with a diluting fluid which comprises an organic solvent.

* * * * *